US008550926B2

(12) United States Patent
Lochtefeld

(10) Patent No.: US 8,550,926 B2
(45) Date of Patent: Oct. 8, 2013

(54) PADDED WATER RIDE SURFACES

(76) Inventor: Thomas J. Lochtefeld, La Jolla, CA (US)

( * ) Notice: Subject to any disclaimer, the term of this patent is extended or adjusted under 35 U.S.C. 154(b) by 977 days.

(21) Appl. No.: 11/716,254

(22) Filed: Mar. 9, 2007

(65) Prior Publication Data

US 2008/0216427 A1 Sep. 11, 2008

(51) Int. Cl.
*A63G 21/18* (2006.01)
*A63C 19/04* (2006.01)

(52) U.S. Cl.
USPC ..... 472/117; 472/90

(58) Field of Classification Search
USPC ..... 472/88–94, 116, 117, 128, 129
See application file for complete search history.

(56) References Cited

U.S. PATENT DOCUMENTS 2,558,759 A 7/1951 Johnson
4,087,088 A 5/1978 Kelso
4,339,122 A 7/1982 Croul
4,557,475 A * 12/1985 Donovan ..... 472/92
5,183,438 A * 2/1993 Blom ..... 472/92
5,447,636 A 9/1995 Banerjee
5,524,310 A * 6/1996 Farnen ..... 14/69.5
5,738,590 A 4/1998 Lochtefeld
6,112,489 A 9/2000 Zweig
6,616,542 B1 * 9/2003 Reddick ..... 473/171
6,676,530 B2 1/2004 Lochtefeld
6,796,096 B1 9/2004 Heath

* cited by examiner

*Primary Examiner* — Kien Nguyen
(74) *Attorney, Agent, or Firm* — J. John Shimazaki

(57) ABSTRACT

The present invention relates to an improvement in the construction of water ride surfaces and comprises at least one layer of soft permeable material built into the padded substrate of a structurally supported ride surface. The permeable material connects to a drainage system and is preferably sandwiched between a slick skin upper waterproof membrane, and a supporting substrate beneath it. The advantage to this improvement is when water leaks through the waterproof membrane, the permeable material prevents water from building up inside the padded substrate, and allows the water to be drained out, rather than blistering and bubbling up under the waterproof membrane, thereby helping to preserve the integrity and longevity of the ride surface.

22 Claims, 8 Drawing Sheets

MECHANICAL FASTENER AND DRAINAGE DETAL

SECTION THROUGH ENTIRE LAYERED SURFACE

LAYERED CONSTRUCTION DETAL

MECHANICAL FASTENER AND DRAINAGE DETAIL. FASTENER WILL VARY. THIN SUBSTRATE EXAMPLE SHOWN.

SECTION THROUGH ENTIRE LAYERED SURFACE

LAYERED CONSTRUCTION DETAL

MECHANICAL FASTENER AND DRAINAGE DETAL

SECTION THROUGH ENTIRE LAYERED SURFACE

PADDED WATER RIDE SURFACES

FIELD OF THE INVENTION

The present invention relates to water ride technologies, and in particular, to improvements in the way water ride surfaces are manufactured and constructed.

BACKGROUND OF THE INVENTION

Water theme parks have become popular in recent years. Water theme parks generally consist of water rides which allow participants to perform various maneuvers or activities in connection with the movement of water thereon. For example, many water parks have water slides that are elongated concave tracks that extend downhill and have water flowing thereon to allow participants to slide down at relatively high speeds. There are also lazy rivers that are man-made channels through which a river-like flow of water is provided to simulate the movement of water down a river. Another popular attraction is the wave pool, which is a man-made body of water, wherein a wave generator is located at one end of the pool, and a simulated beach is located at the other end, wherein waves upon which participants can perform maneuvers are created that travel across the pool from one end to the other.

Another water ride specifically designed to simulate the phenomenon and experience of surfing is a sheet wave water ride known as the Flow Rider® or Wave Loch® which were developed by Applicant. These water rides comprise a padded surface configured and contoured with an incline or wave shape thereon, wherein a sheet flow of water under high pressure is injected onto the ride surface, wherein the water hugs and conforms to the shape of the ride surface, thereby creating a standing wave formation upon which surfing and other skimming maneuvers can be performed. The ride surface in such case is usually adapted so that the flow of water travels from a relatively low point to a relatively high point, wherein a participant can ride on the sheet flow of water, and use gravity to maintain equilibrium thereon. That is, as the sheet flow of water travels upward on the ride surface, the participant is propelled upwardly by the water flow, while at the same time, can use gravity to counteract the upward momentum, to maintain an equilibrium position on the ride surface, which, with enough practice, can be for an extended, if not, indefinite, period of time.

Because various maneuvers are intended to be performed on the ride surface, and because the water ride is designed to propel water under relatively high pressure onto the ride surface, it is important for safety reasons to construct the ride surface using a relatively soft and forgiving material, i.e., in case a participant should fall and land on the ride surface. That is, since the ride surface is configured to enable various maneuvers to be performed thereon, and the water is moving at a rapid pace, the likelihood that a participant could fall and land on the ride surface and become injured must be taken into account, wherein the surface must be constructed in a manner that reduces the possibility of injuries occurring when a participant attempts to ride the ride. Similar water ride elements that require padding are waterslides, river rides and splashdown pools. Often times a waterslide or river ride has a section that requires padding in order to offer collision protection for its participants due to gravity or hydraulically induced interaction between the rider and attraction sides or bottom. Similarly the splashdown pool for a water slide is an area where padding is often needed to soften rider impact and transitions from a high speed to a low speed condition.

Various manufacturing techniques have been used in the past to create a soft and forgiving ride surface in conjunction with water rides. For example, a padded surface comprising an exterior paint coating of waterproofing material and a non-water absorbing foam material underneath has been used in the past to provide a cushioning effect for the water ride surface. To manufacture padded water rides, rolls of closed cell poly-urethane foam were typically unrolled and formed and adhered onto the supporting solid structure, and then, a poly-urethane paint was sprayed or rolled out to create a substantially water impervious barrier with a padded substrate underneath that is both forgiving and ideally waterproof.

One of the disadvantages of this type of construction, however, has been the possibility of water leaking through the waterproof membrane and into the padded substrate underneath, which can lead to deterioration of the glue bonds and/or water trapped beneath the ride surface substrate. For example, when the fusion or adhesion between the polyurethane spray coated waterproofing material is weak or otherwise begins to separate from the underlying foam, or if the poly-urethane top-coat itself begins to wear, i.e., form holes over time, water could eventually seep into the padded substrate through the coating. And although the polyurethane coating is made of durable waterproof materials, the constant expansion and contraction caused by the sun's heat, and the constant wear that occurs by virtue of having participants ride, slide, or bump on the surface repeatedly, can cause this coating to wear down, wherein small cracks, rips, tears and/or even pin-sized holes can be formed thereon, through which water can pass and seep into the padded substrate underneath.

The main problems that can occur when water makes its way underneath the waterproof coating are as follows: First, the water can build up underneath the coating and be stored in pockets either above or below the padded substrate. Pressure from passing water can cause these pockets to grow in size, causing de-laminations in the glue bond between the coating and ride surface or the foam and structural substrate. Second, when the ride is not operating and the hot sun beats down on top of the ride surface, the water that has leaked into the substrate can expand and cause the waterproof coating to blister and bubble. Third, the blistering and bubbling of the waterproof coating can cause additional pressure (much like the expansion of steam in a pressure cooker) causing the coating to break its glue bond and separate from the foam material underneath. Fourth, the water can seep or percolate to the area between the closed cell polyurethane foam and the structural subsurface (e.g., concrete, fiberglass, steel, etc.) and likewise, either through water pressure or sun-induced heat water expansion pressure, cause the top-coat to separate from the foam, or foam to separate from its structural support. The foam separations, glue del-laminations, or top-coat blisters and bubbles can negatively affect the smoothness and therefore performance of the ride surface, and make the coatings, glue and foam more susceptible to further damage.

What is needed therefore is a method and system of improving the ride surface of a water ride to avoid the problems that can occur when water leaks through any coatings and into the padded substrate underneath.

SUMMARY OF THE INVENTION

The present invention relates to a method and system for improving water ride surfaces comprising a means for enabling water that might leak through a waterproof membrane and into the padded substrate underneath to be easily channeled away from the waterproof membrane layer, so as to avoid any of the problems discussed above associated with the leakage and buildup of water in the padded substrate. The present system can be used in connection with any new water ride surface, or any existing water ride surface which might be subject to the same drawbacks and conditions discussed above.

The ride surface itself is intended to be a relatively soft and forgiving surface layer that is blanketed over a supporting structure, such as made of concrete, molded reinforced fiberglass, or stainless steel mesh extended over a frame, or any other supporting structure. The purpose of the ride surface is to provide a cushioning effect for the participants that ride on, slide over, or bump into the water ride, such that they can move freely over and will not be injured when they fall and land on the ride surface. The ride surface generally conforms to the exterior shape of the supporting structure underneath, to form the exterior surface and shape of the water ride, and preferably has a smooth slick waterproof membrane on top, to minimize rider impact, enable a participant to slide over the ride surface and simultaneously limit the seepage of water into the padded substrate below.

The improvement essentially consists of one or more layers of porous or permeable material layered underneath the outer membrane, which has the properties of allowing water to be easily drained from the space beneath the outer membrane, if and when water seeps through. In one embodiment, a permeable vinyl mesh material is sandwiched between the outer membrane above, and the foam material (closed cell) underneath, and adhered to the layers with a special adhesive. This way, whenever there is a breach in the outer membrane which might cause water to leak into the padded substrate, the water will easily drain out from the space under the membrane, such that water will not build up inside. This way, water leaking through the membrane will tend to drain away from the padded substrate underneath, which helps to prevent the membrane from blistering and bubbling up, which, if not controlled, can eventually cause the membrane to separate from the foam material, and can adversely affect the quality, longevity and durability of the ride surface.

In another embodiment, in addition to the permeable vinyl mesh material sandwiched between the outer membrane and the (closed cell) foam material discussed above, there is an additional porous layer underneath the foam material, which allows any additional water that might seep into or underneath the foam material to be drained before it can cause any damage to the padded substrate or its glue laminate layers. In such case, the additional porous layer is preferably an expanded stainless steel mesh that is draped and blanketed over a stainless steel sub frame which forms the supporting structure for the water ride. The stainless steel mesh is preferably welded onto the stainless steel sub frame, and then expanded across the ride surface, to form a relatively firm surface on which the ride surface elements or layers can be attached. The foam material is preferably adhered on top of the stainless steel mesh, and then, the permeable vinyl mesh layer is preferably adhered on top of the foam layer. The outer membrane is then preferably adhered to the top of the vinyl mesh layer.

In another embodiment, directly underneath the outer membrane there is preferably an open cell foam material that allows water and moisture that breaches the outer membrane to be easily drained out through the padded substrate. That is, immediately below the water impervious membrane there is an open cell foam material which enables water that makes its way through the outer membrane to also pass through the open cell foam material, wherein the water can easily be drained through the bottom of the foam. Like the embodiment discussed above, the foam material is preferably adhered to an additional porous layer that is made of an expanded stainless steel mesh that is draped and blanketed over a stainless steel sub frame which forms the supporting structure for the water ride. This way, any water that might otherwise build up inside the foam material can easily pass through underneath the layer of foam.

As in the case of previous ride surfaces, the foam and outer membrane materials are likely to come in strips, and then rolled out to form the shape of the ride surface, wherein the strips are preferably heat welded, glued or otherwise adhered together along their seams to form a contiguous layer on top. The additional permeable or porous layer directly underneath the outer membrane is preferably adhered together along the seams to ensure that the entire ride surface forms a contiguous member that minimizes rider impact, enables a participant to slide over the ride surface and simultaneously limits the seepage of water into the padded substrate below. The stainless steel mesh can be welded at the joints and to the sub structure underneath to form a contiguous supporting structure for the ride surface elements above it.

There are preferably a number of mechanical fasteners intermittently spaced apart to lock the layers together. The mechanical fasteners preferably comprise plastic loops or ties which are extended through holes in the layers to mechanically bond the layers together, in case the glue that keeps the layers together eventually wears out. The fasteners are intended to be extended through each layer in the substrate except the top waterproof membrane. The holes that are formed in the lower layers to enable the fasteners to be connected are then used to allow the water to be drained out of the substrate, i.e., by gravity alone. In such case, the water in the permeable layer will preferably find its way through the holes and pass down through and underneath the substrate, where it can then be drained and captured in a reservoir, or other container, and then re-cycled back to feed the water ride, or eliminated to waste, as necessary. The fasteners can also be adapted to lock the entire ride surface structure on top of the supporting structure.

Other embodiments not specifically disclosed herein which are consistent with the goals and objectives of the present invention set forth herein are contemplated within the scope of this invention.

DETAILED DESCRIPTION OF THE INVENTION

Figure 1:
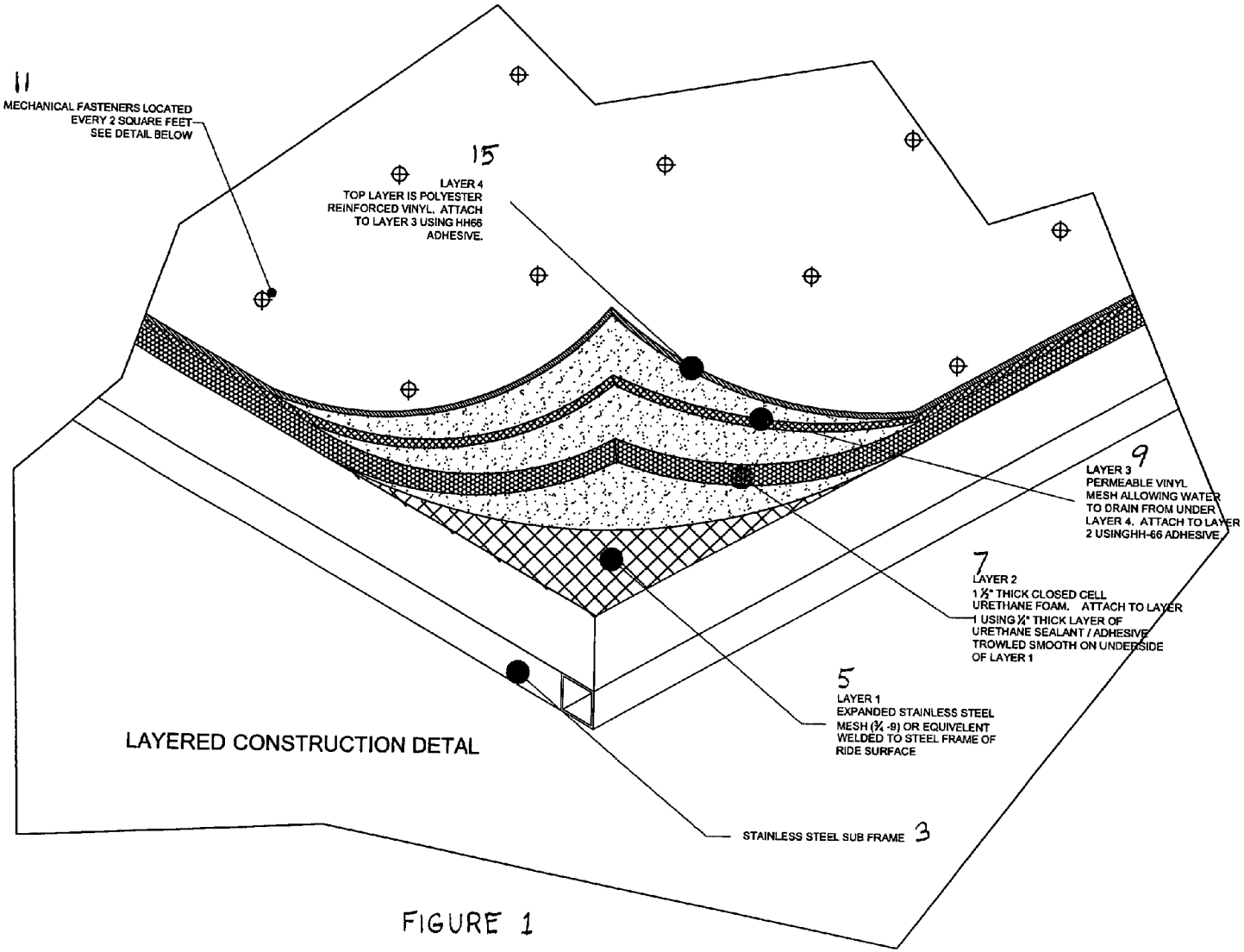
FIG. 1 is a schematic drawing showing the padded water ride surface of the present invention with various layers, including a waterproof membrane on top, and a permeable mesh layer sandwiched between the waterproof membrane and foam layer underneath, wherein the foam layer is positioned and adhered on top of a stainless steel mesh that is expanded and positioned over a stainless steel sub frame.

Water rides are typically built directly into the ground, or on other firm foundation, or structure, which can support the weight of the water ride, the water and its participants. They tend to be constructed out of strong and durable materials, such as concrete, stainless steel, fiberglass, etc., insofar as they must be capable of supporting the weight and movement of not only the participants, but also the water that typically travels and flows on top of it. A typical lazy river, for example, is constructed using a concrete channel to support the weight and movement of the water and participants through it. Water slides are typically made of durable fiberglass and/or concrete, with strong stainless steel frames to support the slide.

The sheet wave water rides developed by Applicant are also typically constructed out of strong and durable materials. For example, they can be made using a sub-structure made of concrete, molded reinforced fiberglass, and/or stainless steel sub frame, or any other material, or combination thereof. This construction preferably provides the physical characteristics and qualities that are required to support the ride elements, including the ride itself, the water, and the participants, as well as the high pressure sheet flow of water that travels across the ride surface.

When concrete is used to construct the supporting structure, the supporting structure is typically poured into a solid foundation, wherein the concrete structure is formed with an exterior shape that is in the desired shape of the water ride. Cement can be poured into a mold, or other mold-like structure, so that when it sets, the concrete will form the desired exterior shape, which can, for example, be in the shape of a standing wave formation.

When fiberglass is used, a reinforced fiberglass shell is preferably formed in a conventional manner, in the desired water ride shape. When fiberglass is used to create a water slide, for example, the fiberglass is molded into elongated channel sections, which can be connected together to form a long continuous channel over which the water and participants can travel. The supporting structure can be made using any conventional sub frame material, such as stainless steel, or concrete, etc., which can be adapted to support the water slide, from top to bottom. When Applicant's sheet wave water ride is made using fiberglass, it is preferable that the supporting structure be formed using multiple sections that can be pieced, connected and adhered together to form a contiguous supporting structure that supports the ride surface. A supporting sub frame structure, such as one made of stainless steel, or other material, can be provided to support the weight of the structure, as well as the weight of the ride surface elements, the water, and the participants, etc., thereon.

In Applicant's sheet wave water ride, one preferred method of creating the supporting structure is the use of a stainless steel sub frame with an expanded stainless steel mesh that extends over and across the sub frame to form a t relatively firm web on which the ride surface elements can be adhered. In this respect, the sub frame is preferably formed and shaped to have an exterior mesh thereon that forms the overall shape of the ride surface. When the stainless steel mesh is set in place and welded to the sub frame, the stainless steel mesh forms the overall shape of the ride surface, wherein the padded surface elements, as will be discussed, can then be attached thereto. The mesh is preferably formed in sections and is relatively rigid and can be spot welded onto the sub frame to form the supporting structure.

Figure 3:
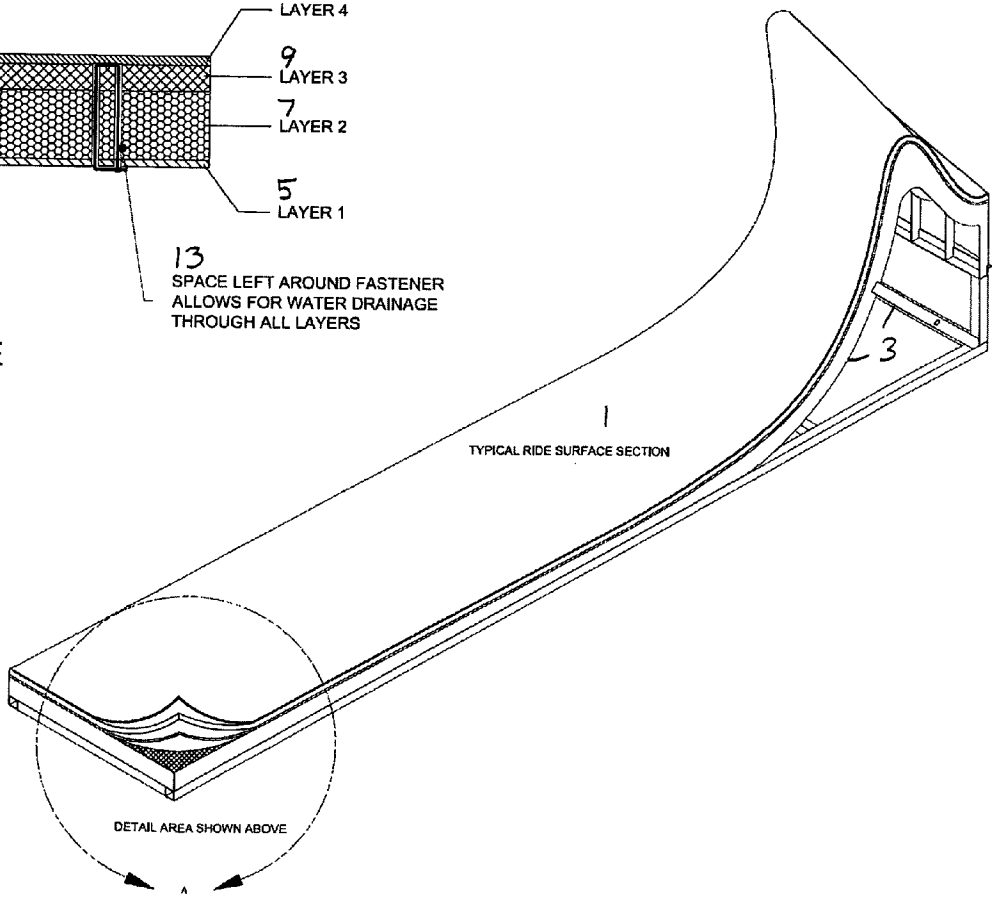
FIG. 3 is a schematic drawing showing a typical sheet wave water ride surface being supported by a typical sub frame structure, and the location of the detail shown in FIG. 1 relative to the ride surface.

FIG. 1 shows a construction detail which shows the various layers that are formed on top of a stainless steel sub frame 3, which is also shown in FIG. 3, which shows a section of a typical ride surface 1. Sub frame 3 preferably provides structural support for the ride surface elements that are located on top of it, and spans the entire distance across the ride surface 1. Sub frame 3 is preferably constructed on, and supported by, a firm solid foundation, such as a concrete slab, or other conventional support structure underneath. When it is desirable to have water flow across the ride surface, and empty out into a reservoir underneath, a pool-like structure (not shown) is preferably constructed under and around the sub frame 3, wherein water draining from the ride surface can be captured and contained therein, and redistributed, if necessary, to where it can be re-injected back onto the ride surface 1. The pool-like structure can be made of concrete or any other conventional material, much like a standard swimming pool, and is preferably made large enough so that water used by the water ride can be captured, re-circulated and used to operate the water ride. Sub frame 3 is preferably made of stainless steel, fiberglass, concrete or any other strong, durable and rust resistant material.

A stainless steel mesh 5 (layer 1 shown in FIG. 1) is preferably extended over the sub frame 3 and secured such that it forms a relatively firm back wall on which to support the ride surface elements of the present invention. In the preferred embodiment, the stainless steel mesh 5 is formed in sections and is relatively rigid and spot welded onto the sub frame 3 in a conventional manner, or otherwise adhered, bonded or fused to the sub frame 3 by any conventional means. Stainless steel mesh 5 is preferably configured such that any water that might seep through the padded substrate above it will pass through the mesh 5, and down into the pool-like structure underneath, such that water will not build up inside the padded substrate layers. The open weave nature of the stainless steel mesh 5 naturally allows water to pass through, while at the same time, provides a relatively strong and durable supporting structure that can be configured into the desired shape of the ride surface, i.e., to support the ride surface elements above it. Other materials that provide the same or similar characteristics as the stainless steel mesh 5 (e.g., fiberglass, concrete, etc.) are contemplated by the present invention.

Above the stainless steel mesh 5 is preferably provided a layer of foam material 7 (layer 2 shown in FIG. 1) which is relatively soft and forgiving, such as a layer of closed cell urethane foam. The foam preferably has the ability to be compressed when pressure is applied, and has memory to return to its original configuration. The closed cell nature of the foam helps to prevent water from seeping into the padded substrate. How thick the foam material should be is dependent on the type of water ride surface that is being constructed, the type of use the water ride is intended to be subjected to, and the denseness and forgiving nature of the foam material selected and used, to name only a few. If the risk of impact is low, then, only a thin porous substrate is required sufficient to allow water to drain and avoid pressure buildup. Alternatively, the greater the risk of rider impact, then, a thicker porous substrate or additional foam padding can be added to create a soft and impact resilient surface. In the preferred embodiment of Applicant's water ride, it has been found that a layer of foam that is one and one-half inches thick is likely to be sufficient to provide an adequate level of protection for the ride surface. The foam material can be made using virtually any thickness that achieves the desired results, i.e., to provide an adequate amount of cushioning effect, which provides protection for the participants on the ride surface 1.

Because the foam material typically comes in strips, the foam material is preferably rolled out over the supporting structure, which, in this case, is the stainless steel mesh. The foam material will typically conform to the shape of the supporting structure, to form the exterior shape of the water ride surface. The foam material is preferably adhered onto the stainless steel mesh 5 using a heat weld, i.e., where heat is applied to the stainless steel mesh to melt the foam onto the mesh, or, a layer of adhesive, such as a one-fourth inch thick layer of urethane sealant or other adhesive that has been smoothed onto and applied to the foam material 7 and/or stainless steel mesh 5. It has been found that a polyurethane adhesive by the name of Silkaflex 221 is suitable for this purpose. The foam material strips can be adhered together along their seams, to form a contiguous foam layer 7 on top of the supporting structure.

Above the foam layer 7 is preferably provided a layer of permeable mesh material 9 (layer 3 shown in FIG. 1) which is adapted to allow water to pass through it, such that any water that might leak through the outer membrane and into the padded substrate can be drained by gravity alone. It has been found that a vinyl loop or web matting material, such as Nomad Entrance or Scraper Matting made by 3M, which are made with a resilient vinyl loop or web construction, is a suitable material for this application. The permeable material 9 can be any similar mesh or material that will allow water to drain through it, such that if there is leakage from the outer layer into the padded substrate, the water will not build up inside the substrate. The permeable mesh material 9 preferably has enough strength and durability so that it can be used to bond the outer membrane to the foam material 7, and enough flexibility so that it will not alter the performance characteristics of the foam material 7.

How thick the permeable material 9 should be is dependent on the nature of the characteristics that are desired to be achieved, wherein the following should be taken into account: When the permeable material 9 is relatively thick, it will allow more water to pass through, whereas, when the material 9 is too thick, it can weaken the bond between the outer membrane and foam material. Additionally, the cost of the permeable membrane material is directly related to its thickness (i.e., increase material=increased cost) so at some point the benefits of increased thickness for water permeability is outweighed by the cost. Therefore, the thickness should take into account all three of these factors, wherein a sufficient amount of drainage, cushion and strength properties should be considered and achieved.

Because the permeable material 9 typically comes in strips, the permeable material is preferably rolled out and formed over the foam material 7, and can be adhered thereon using a layer of adhesive, such as vinyl cement or other similar adhesive. The vinyl cement can be smoothed onto and applied to the foam material 7 and/or the permeable material 9, for proper adhesion to occur. It has been found that vinyl cement referred to as HH-66 provided by Imperial or 3M's 1099 is suitable for this purpose. The permeable material strips can be adhered or otherwise secured together along their seams, to form a contiguous permeable material layer 9 on top of the foam material layer 7.

Figure 2:
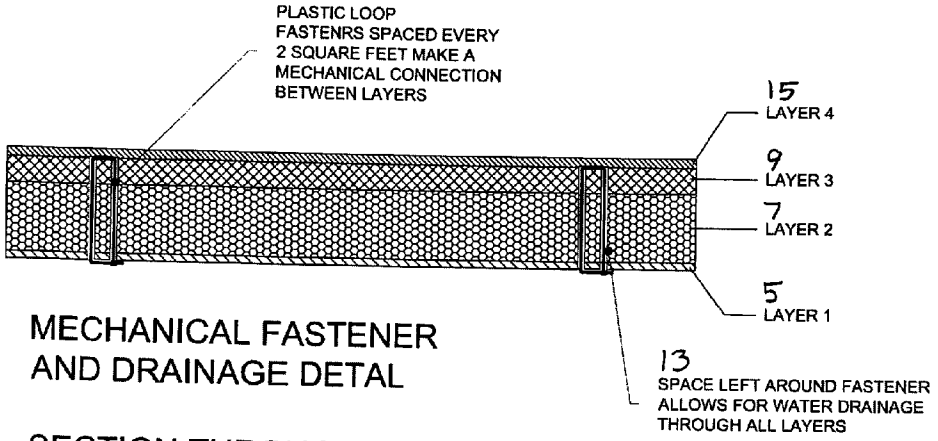
FIG. 2 is a detail drawing showing how the mechanical fasteners are extended through the padded substrate layers of FIG. 1, except the outer membrane, and used to secure the ride surface to the supporting structure underneath.

To properly mount the layers together, there are preferably a number of mechanical fasteners 11 intermittently spaced apart to lock the layers together, as shown in FIGS. 1 and 2. The mechanical fasteners 11 preferably comprise plastic loop ties or other connectors that are extended through holes 13 in the layers to mechanically bond the layers together, in case the glue that keeps the layers together is spotty or eventually wears out. As shown in FIG. 2, each fastener 11 is preferably extended through a hole 13 that extends through the foam material 7 and permeable material 9, and is then connected to the supporting structure underneath, i.e., the stainless steel mesh 5, or sub frame 3, or both. Preferably, the holes 13 and fasteners 11 are not extended through the top waterproof membrane, to prevent additional leakage through the outer layer. The holes 13 are adapted so that water that drains through the permeable material 9 will more easily pass through the substrate (through the holes) and out through the bottom of the foam layer, rather than being trapped therein. The fasteners 11 can also be adapted to lock the entire ride surface on top of the supporting structure 5.

Figure 4:
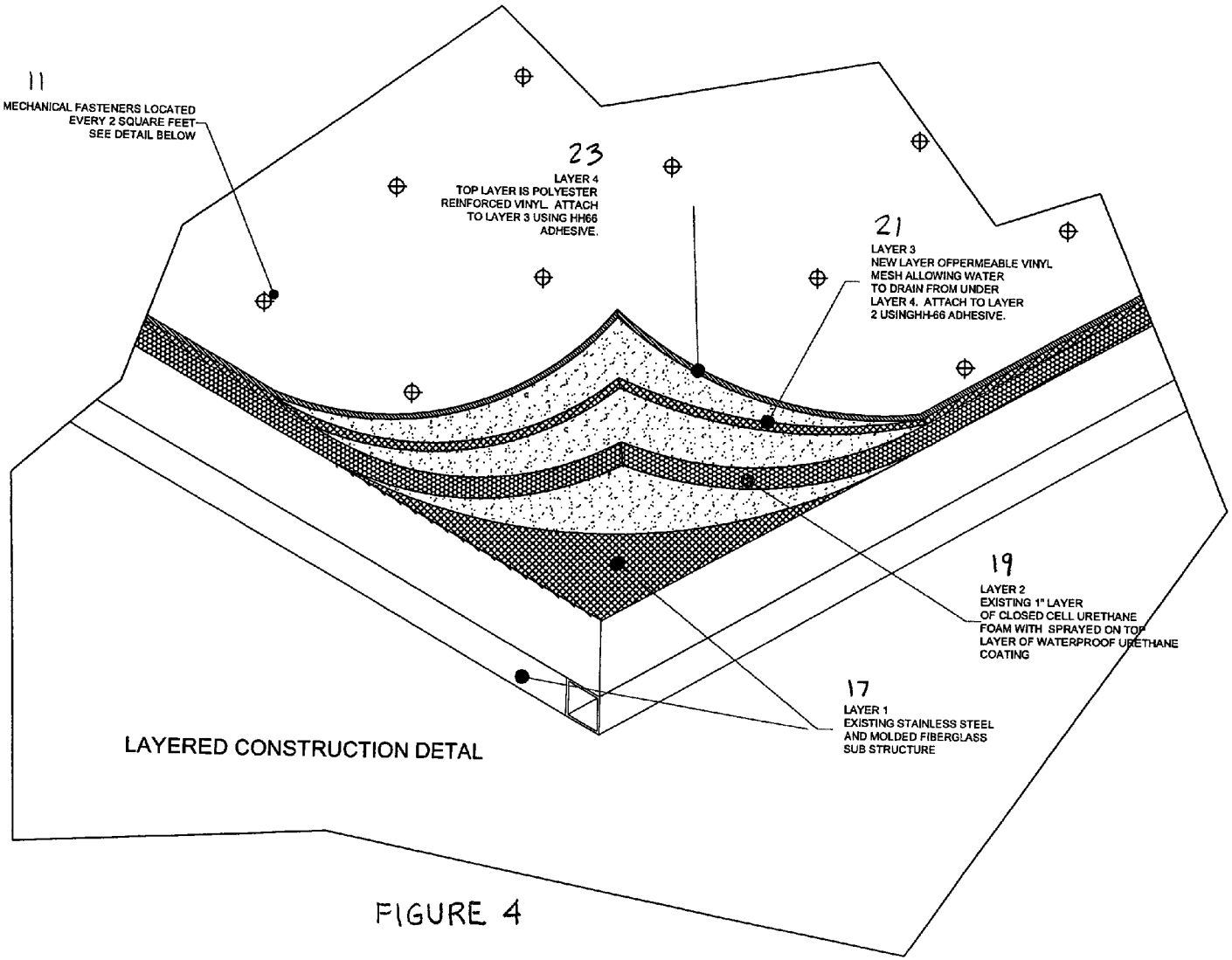
FIG. 4 is a schematic drawing showing a retro-fit application of the padded water ride surface of the present invention with various layers, including a waterproof membrane on top, and a permeable mesh layer sandwiched between the waterproof membrane and a pre-existing top-coated foam layer underneath, with the foam layer positioned and adhered on top of a stainless steel and molded fiberglass sub structure underneath.
Figure 5:
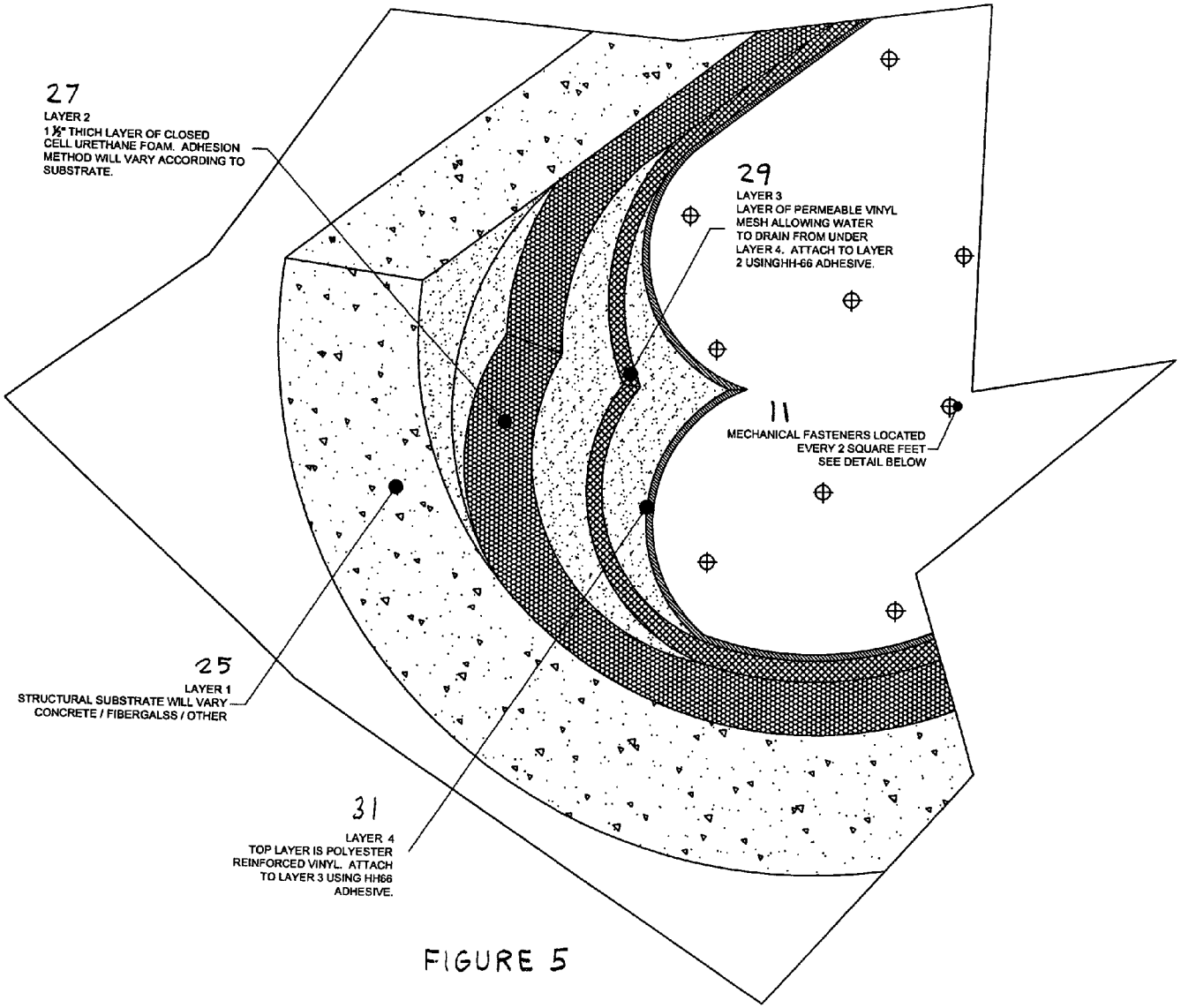
FIG. 5 shows a construction detail of the padded water ride surface of the present invention with various layers, including a waterproof membrane on top, and a permeable mesh layer sandwiched between the waterproof membrane and foam layer underneath, wherein the foam layer is positioned and adhered on top of a concrete or fiberglass supporting structure adapted to be used in a water slide or lazy river.

Preferably, the number of fasteners 11 that are used will be a function of how secure the layers need to be, and on how much drainage is required for the ride surface to operate and be maintained properly. In the preferred embodiment, the fasteners are preferably spaced apart at two feet intervals, both lengthwise and widthwise, such that there is a fastener 11 and opening 13 every two square feet on the ride surface, as shown in FIGS. 1, 4 and 5. A plurality of openings 13 is also preferably provided along the lowest edge of the ride surface, to allow water to properly drain out from the padded substrate, i.e., along the bottom edge thereof.

Above the permeable layer 9 is preferably provided a layer of waterproof membrane material 15 (layer 4 shown in FIG. 1) which is adapted to provide a water impervious layer on top of the water ride surface 1. It has been found that a vinyl fabric material, such as Precontrait series 8000, is a suitable material for this application. The waterproof membrane 15 can be any similar material that can be attached to or sprayed on or otherwise applied to the permeable material 9 that provides the waterproof characteristics of the ride surface. The membrane 15 is preferably strong and durable to withstand repeated use by participants on the ride surface, and has enough flexibility so that it will not alter the performance characteristics of the foam material 7 underneath.

How thick the waterproof membrane 15 should be is dependent on the performance characteristics that are desired to be achieved. Although the thicker the layer 15, the stronger it will be, and the more it will withstand wear, when the layer 15 is too thick, it can lose flexibility, which is essential in being able to provide the cushioning effect necessary to protect the participants. Also, when the layer 15 is too thick, it can become difficult to form the material into the appropriate exterior curved shape of the ride surface. Therefore, the thickness should take into account these factors, wherein sufficient flexibility and strength should be considered and achieved.

Because the waterproof membrane 15 typically comes in strips, the material is preferably rolled out and formed over the permeable material 9, and takes on the shape of the permeable material 9. It can be adhered onto the permeable material 9 using a layer of adhesive, such as vinyl cement or other similar adhesive. The vinyl cement can be smoothed onto and applied to the permeable material 9 and/or waterproof material 15, for proper adhesion to occur. It has been found that vinyl cement called HH-66 provided by Imperial or any commercial grade methyl-2-cyanoacrylate is suitable for this purpose. The waterproof material 15 comes in strips that are preferably glued or otherwise adhered together, such as by being fused, along their seams, to form a contiguous water impervious layer on top of the ride surface 1.

As discussed, although every attempt is made to ensure that this outer membrane layer 15 is waterproof, over time, it has been found that leakage will eventually occur. Therefore, the construction of the various layers of the present invention helps to ensure that when water does leak through the waterproof membrane 15, and into the padded substrate, the water has a way of being able to drain out, so that the water does not build up inside the padded substrate, and the blistering and bubbling effects identified above do not occur.

FIG. 4 shows a similar construction detail which shows the various layers that are retro-fitted and formed on top of an existing stainless steel and molded fiberglass sub structure 17 (layer 1 shown in FIG. 4). This construction can be applied to the ride surface in much the same way as the construction shown in FIG. 1, except this uses an existing fiberglass sub structure, rather than a stainless steel mesh. The sub frame 3 can be essentially the same as shown in FIG. 3, and preferably provides structural support for the ride surface elements that are located on top of it, and spans the entire distance across the ride surface 1. Sub frame 3 is preferably constructed on, and supported by, a similar solid foundation underneath, and/or a reservoir around the ride surface, such as the pool-like structure discussed above.

Above the molded fiberglass structure 17 is preferably provided a layer of foam material 19 (layer 2 shown in FIG. 4) which is relatively soft and forgiving, such as a thick layer of closed cell urethane foam. The foam preferably has the ability to be compressed when pressure is applied, and has memory to return to its original configuration. Again, how thick the foam material should be is dependent on a number of factors, including the type of water ride surface it is, the type of use it is subjected to, and the denseness and forgiving nature of the foam material selected. This example shows a one inch layer of existing foam material 19, with a layer of waterproof material, such as a urethane coating provided or sprayed thereon, which further prevents the seepage of water into the foam. The closed cell nature of the foam also helps to prevent water from seeping into the padded substrate. Again, the foam material can be made in virtually any thickness that achieves the desired results, i.e., to provide an adequate amount of cushioning for the ride surface.

Because the foam material typically comes in strips, the foam material is preferably rolled out and formed over the supporting structure, which, in this case, is the molded fiberglass structure, to form the exterior shape of the water ride. The foam material is preferably adhered onto the fiberglass structure 17 using a layer of adhesive, such as a contact cement or other similar adhesive that has been smoothed onto and applied to the foam material 19 and/or fiberglass structure 17. It has been found that the adhesive Silkaflex 221 is suitable for this purpose. The foam strips can be adhered together along their seams, to form a contiguous foam layer 19 on top of the supporting structure 17.

As in the previous embodiment, above the foam layer 19 is preferably provided a layer of permeable mesh material 21 (layer 3 shown in FIG. 4) which is adapted to allow water to pass through it, such that any water that leaks through the outer membrane and into the padded substrate can be drained out before it builds up. It has been found that Nomad Entrance or Scraper Matting made by 3M, which are made with a resilient vinyl loop or web construction, are suitable materials for this application. The permeable material 21 can be any similar mesh or material that will allow water to drain through it, to prevent water from building up inside the padded substrate. Again, the permeable material 21 preferably has enough strength and durability so that it can be used to bond the outer membrane to the foam material 19, and enough flexibility so that it will not alter the performance characteristics of the foam. The thickness of the permeable material 21 is dependent on the same factors discussed above in connection with the previous embodiment.

Because the permeable material 21 typically comes in strips, the permeable material is preferably rolled out and formed over the foam material 19, and can be adhered to the foam material 19 using a layer of adhesive, such as vinyl cement or other similar adhesive. The vinyl cement can be applied in a similar manner discussed above in connection with the previous embodiment, and the same vinyl cement material can be used. The permeable strips can also be adhered or otherwise connected together along their seams, to form a contiguous permeable layer 21.

As with the previous embodiment, to properly mount the layers together, a number of mechanical fasteners 11 intermittently spaced apart can be used to lock the layers together. Again, the mechanical fasteners 11 preferably comprise plastic loop ties or other connectors which are extended through holes 13 to mechanically bond the layers together. The fasteners 11 are preferably extended through holes 13 that extend through the foam material 19 and permeable material 21, and then connected to the supporting structure underneath. Preferably, the holes 13 and fasteners 11 are not extended through the top waterproof membrane. The holes 13 are adapted so that the water that drains through the permeable material 21 will more easily pass through the foam material 19 and out through the bottom of the padded substrate, rather than being trapped therein.

Above the permeable layer 21 is preferably provided a layer of waterproof membrane material 23 (layer 4 shown in FIG. 4) which is adapted to provide a water impervious layer on top of the ride surface. Again, a vinyl fabric material, such as Precontrait series 8000, is a suitable material for this application. The waterproof membrane 23 can be any similar material that will provide the waterproof characteristics needed by the ride surface. The waterproof membrane 23 is preferably strong and durable to withstand repeated use by participants on the ride surface, and has enough flexibility so that it will not alter the performance characteristics of the foam underneath. Again, how thick the waterproof material 23 is, is dependent on the performance characteristics that are desired to be achieved, as discussed above.

Because the waterproof material 23 typically comes in strips, the material is preferably rolled out and formed over the permeable material 21, and can be adhered onto the permeable material 21 using a layer of adhesive, such as HH-66 vinyl cement or other similar adhesive. The vinyl cement can be smoothed onto and applied to the permeable material 21 and/or the waterproof material 23, for proper adhesion. Again, the waterproof strips are preferably glued or otherwise adhered together, such as by being fused, along their seams, to form a contiguous water impervious layer 23 on top of the ride surface 1.

Figure 7:
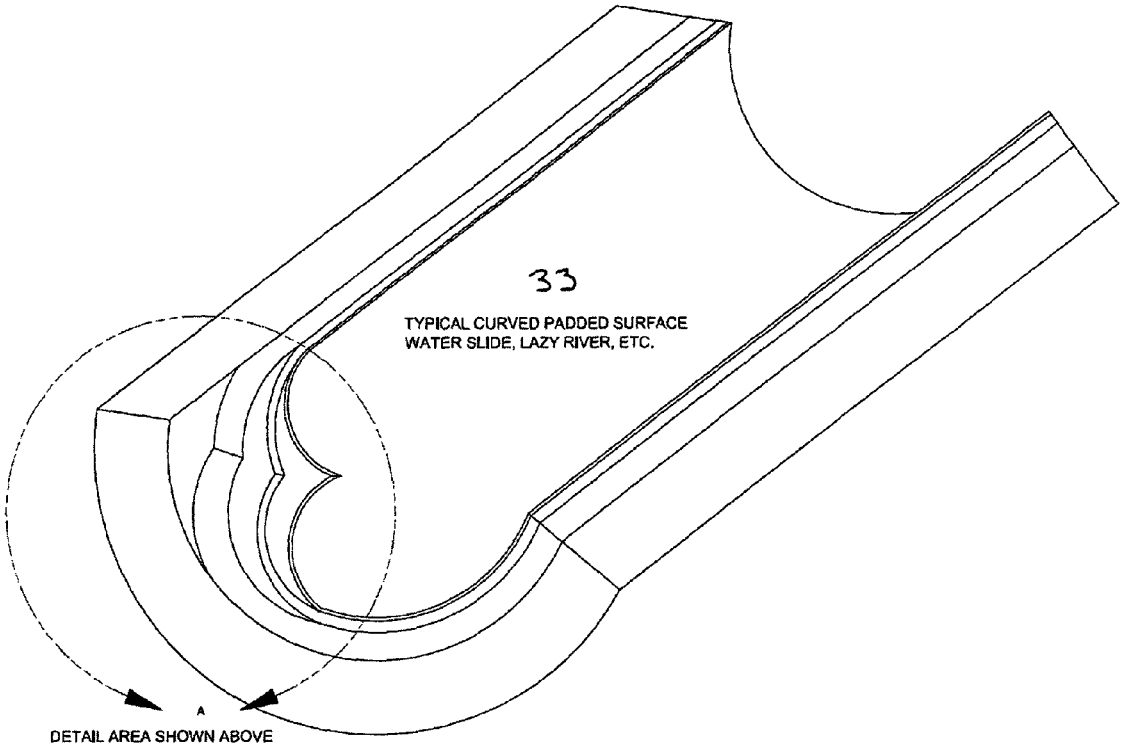
FIG. 7 shows a construction detail showing a typical water slide or lazy river ride surface with the location of the detail shown in FIG. 5 circled.

FIG. 5 shows a similar construction detail which shows the various layers that are formed on top of a concrete or molded fiberglass sub structure 25 (layer 1 shown in FIG. 5). This construction can be applied to the ride surface in much the same way as the constructions shown in FIGS. 1 and 4, except that this shows the supporting structure to be a concrete or fiberglass sub structure in the shape of a concave channel, such as for a lazy river or water slide 33, as shown in FIG. 7. The sub structure 25 is preferably constructed on, and supported by, a solid foundation, or reservoir, underneath, as discussed.

Above the concrete or fiberglass sub structure 25 is preferably provided a layer of foam material 27 (layer 2 shown in FIG. 5) which is relatively soft and forgiving, such as a thick layer of closed cell urethane foam. Again, how thick the foam material should be is dependent on a number of factors, including the type of water ride surface it is, the type of use it is subjected to, and the denseness and forgiving nature of the foam material selected. This example shows a one and one half inch thick layer of foam material 27, to provide an adequate amount of cushioning effect over the concrete. The closed cell nature of the foam helps to prevent water from seeping into the padded substrate.

Because the foam material 27 typically comes in strips, the foam material is preferably rolled out and formed over the supporting structure, which, in this case, is the concrete or fiberglass sub structure 25, to form the exterior shape of the water ride surface. The foam material 27 is preferably adhered onto the sub structure 25 using a layer of adhesive, such as a one-fourth inch thick layer of urethane sealant or other similar adhesive that has been smoothed onto and applied to the foam and/or sub structure 25. It has been found that Silkaflex 221 is suitable for this purpose. Again, the foam strips can be adhered together along their seams, to form a contiguous foam layer 27 on top of the sub structure 25.

As in the previous embodiments, above the foam layer 27 is preferably provided a layer of permeable mesh material 29 (layer 3 shown in FIG. 5) which is adapted to allow water to pass through it, such that any water that might leak through the outer membrane and into the padded substrate can be drained. It has been found that Nomad Entrance or Scraper Matting made by 3M, which are made with a resilient vinyl loop or web construction, is a suitable material for this application. The permeable material 29 can be any similar mesh or material that will allow water to drain through it, to prevent water from building up inside the padded substrate. Again, the permeable material 29 preferably has enough strength and durability so that it can be used to bond the outer membrane to the foam layer 27, and enough flexibility so that it will not alter the performance characteristics of the foam. The thickness of the permeable material 29 is dependent on the same factors discussed above in connection with the previous embodiments.

Because the permeable material 29 typically comes in strips, the permeable material is preferably rolled out and formed over the foam material 27, and can be adhered onto the foam using a layer of adhesive, such as vinyl cement or other similar adhesive. The vinyl cement can be applied in a similar manner discussed in connection with the previous embodiments, and the same vinyl cement material can be used. The permeable strips can be adhered together along their seams, to form a contiguous permeable material layer 29.

Figure 6:
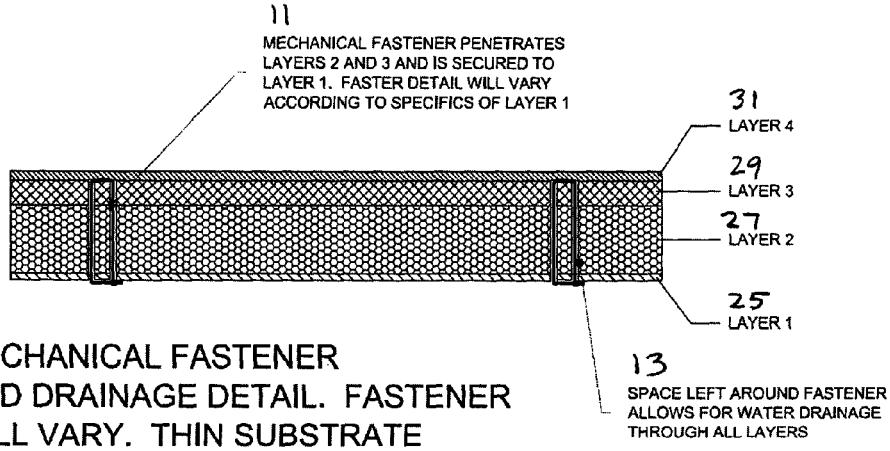
FIG. 6 is a detail drawing showing how the mechanical fasteners are extended through the padded substrate layers of FIG. 5, except the outer membrane, and used to secure the ride surface to the supporting structure underneath.

As with the previous embodiments, to properly mount the layers together, a number of mechanical fasteners 11 intermittently spaced apart can be used to lock the layers together, as shown in FIG. 6. Again, the mechanical fasteners 11 preferably comprise plastic loop ties or other connectors which are extended through holes 13 in the layers to mechanically bond the layers together. The fasteners 11 are preferably extended through holes 13 that extend through the foam material 27 and permeable material 29, and then connected to the supporting structure underneath. Preferably, the holes 13 and fasteners 11 are not extended through the top waterproof membrane, to prevent additional leakage thereon. The holes 13 are adapted so that water that drains through the permeable material 29 will more easily pass through the foam layer (through the holes) and out through the bottom of the padded substrate, rather than being trapped therein.

Above the permeable layer 29 is preferably provided a layer of waterproof membrane material 31 (layer 4 shown in FIG. 5) which is adapted to provide a water impervious layer on top of the water ride surface. Again, a vinyl fabric material, such as Precontrait series 8000, is a suitable material for this application. The waterproof membrane 31 can be any similar material that will provide the waterproof characteristics for the ride surface. The waterproof membrane 31 preferably is strong and durable to withstand repeated use by participants on the ride surface, and has enough flexibility so that it will not alter the performance characteristics of the foam underneath. Again, how thick the waterproof material 31 should be is dependent on the performance characteristics that are desired to be achieved, as discussed above.

Because the waterproof material 31 typically comes in strips, the material is preferably rolled out and formed over the permeable material 29, and can be adhered onto the permeable material 29 using a layer of adhesive, such as HH-66 vinyl cement or other similar adhesive. The vinyl cement can be smoothed onto and applied to the permeable material 29 and/or waterproof material 31, for proper adhesion. Again, the waterproof strips are preferably glued or otherwise adhered together, such as by being fused, along their seams, to form a contiguous water impervious layer 31 on top of the ride surface.

Figure 9:
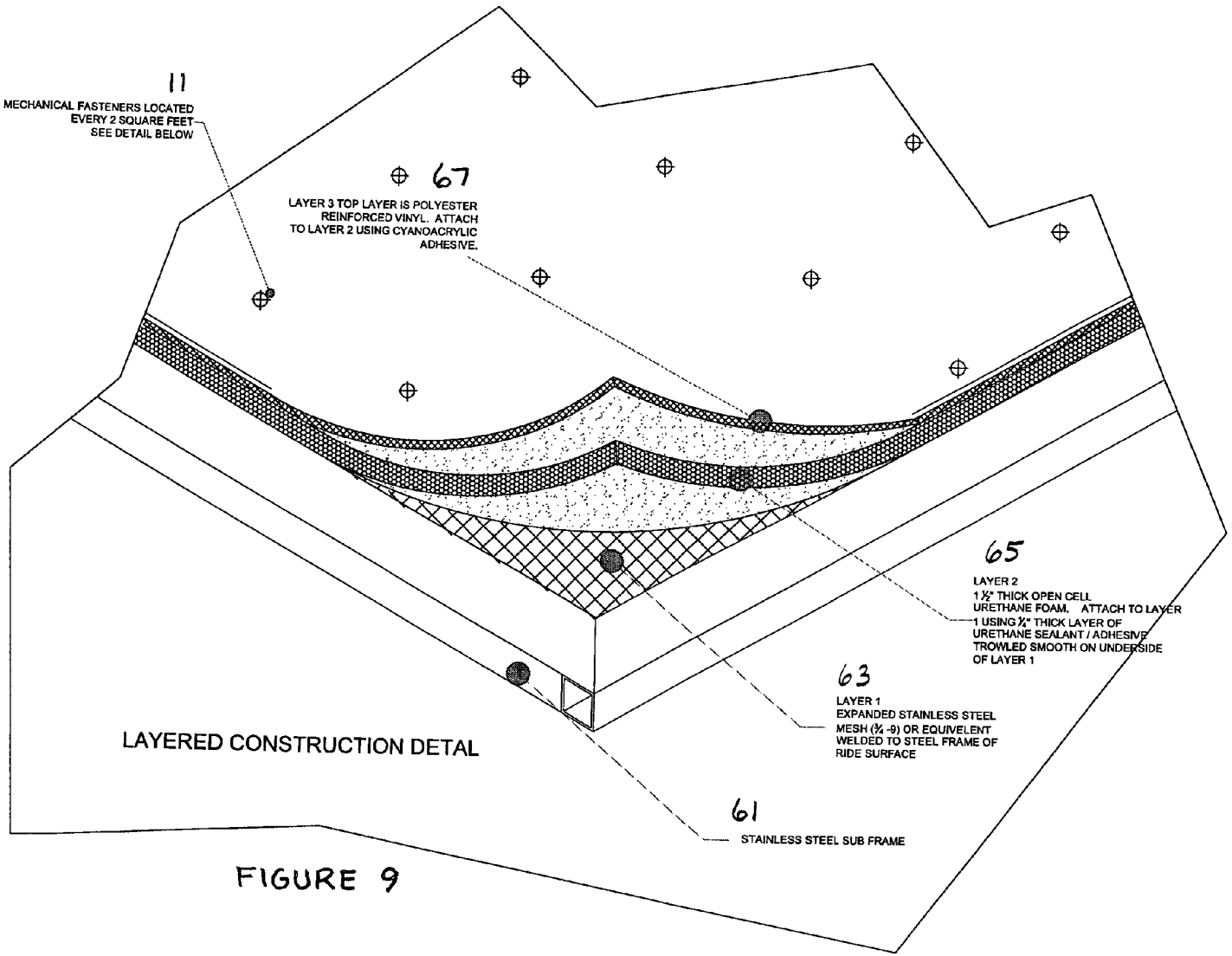
FIG. 9 is a schematic drawing showing the padded water ride surface of the present invention with various layers, including a waterproof membrane on top, and an open cell foam layer underneath, wherein the foam layer is positioned and adhered on top of a stainless steel mesh that is expanded over a stainless steel sub frame.
Figure 11:
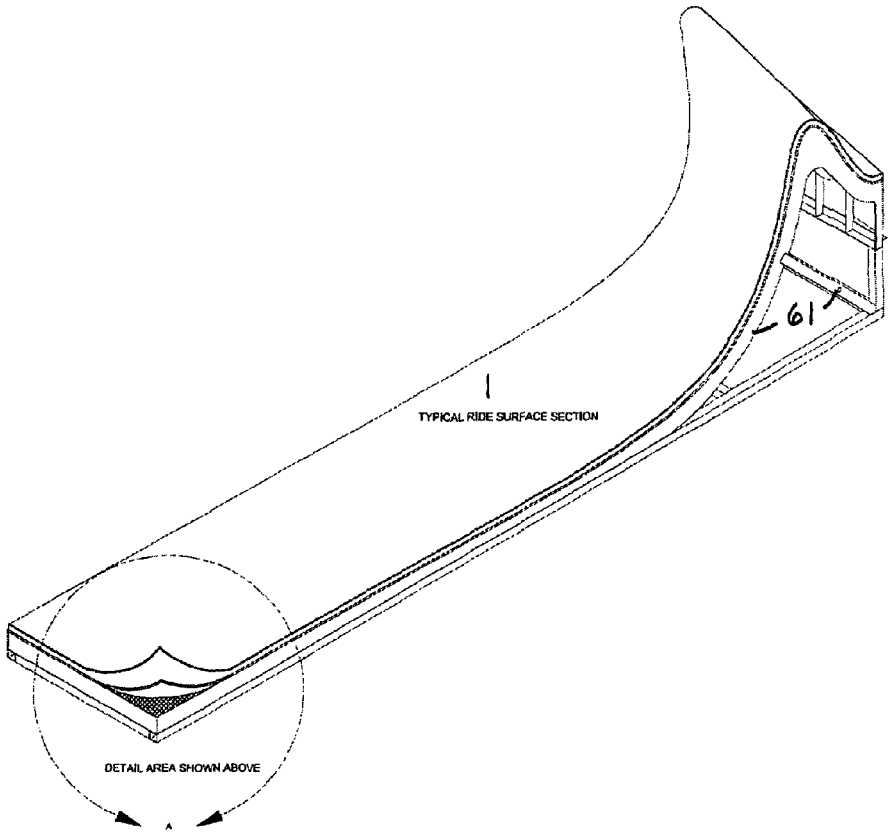
FIG. 11 is a schematic drawing showing a typical sheet wave water ride surface being supported by a typical sub frame structure, and the location of the detail shown in FIG. 9 relative to the ride surface.

FIG. 9 shows a similar construction detail which shows the various layers that are formed on top of a stainless steel mesh 63 similar to the one shown in FIG. 1. Like that previous embodiment, there is preferably a sub frame 61 to provide structural support for the ride surface elements that are located on top of it, as shown in FIG. 11. Sub frame 61 is preferably constructed on, and supported by, a firm solid foundation, such as a concrete slab, or other conventional structure, or reservoir, underneath. When a reservoir is used, there is preferably a pool-like structure (not shown) constructed under and around the sub frame 61, wherein water draining from the ride surface can be captured and contained therein, and redistributed or eliminated, as necessary, to where it can be re-injected back onto the ride surface. Sub frame 61 is preferably made of stainless steel or any other strong, durable and rust resistant material.

Stainless steel mesh 63 (layer 1 shown in FIG. 9) is preferably expanded over the sub frame 61 to support the ride surface elements of the present invention. The stainless steel mesh 63 is preferably formed in sections, and is relatively rigid, and spot welded onto the sub frame 61 in a conventional manner. Stainless steel mesh 63 is preferably configured such that any water that might seep through the padded substrate above it will pass through the mesh 63, and down into the pool-like structure underneath. Other materials that provide the same or similar characteristics as the stainless steel mesh 63 are contemplated by the present invention.

Above the stainless steel mesh 63 is preferably provided a layer of foam material 65 (layer 2 shown in FIG. 9) which, in this embodiment, is relatively soft and forgiving, but is preferably a thick layer of open cell urethane foam. The foam preferably has the ability to be compressed when pressure is applied, and has memory to return to its original configuration. The open cell nature of the foam in this embodiment helps to allow water to pass through the padded substrate, without having to use any additional permeable layer of material above it, as in the previous embodiments. How thick the open cell foam material should be is dependent on the type of water ride surface that is being constructed, the type of use the water ride is intended to be subjected to, and the denseness and forgiving nature of the foam material selected and used. In the preferred embodiment, it has been found that a layer of foam that is one and one-half inches thick is likely to be sufficient to provide an adequate level of protection for the ride surface.

Because the open cell foam material typically comes in strips, the foam material is preferably rolled out and formed over the supporting structure, which, in this case, is the stainless steel mesh. The foam material will typically conform to the shape of the supporting structure, to form the exterior shape of the water ride surface. The foam material 65 is preferably heat welded to the stainless steel mesh 63, at joint 68, by heating the mesh and then fusing the foam directly onto the mesh, via the heat transferred from the mesh to the foam. Alternatively, it can be adhered onto the stainless steel mesh 63 using a layer of adhesive, such as a one-fourth inch thick layer of urethane sealant or other adhesive that has been smoothed onto and applied to the foam material 65 and/or stainless steel mesh 63, except that the adhesive could prevent water from passing freely down through the foam. It has been found that a polyurethane adhesive by the name of Silkaflex 221 is suitable for this purpose. The foam material strips can be adhered together along their seams, to form a contiguous foam layer 65 on top of the supporting structure.

Figure 12:
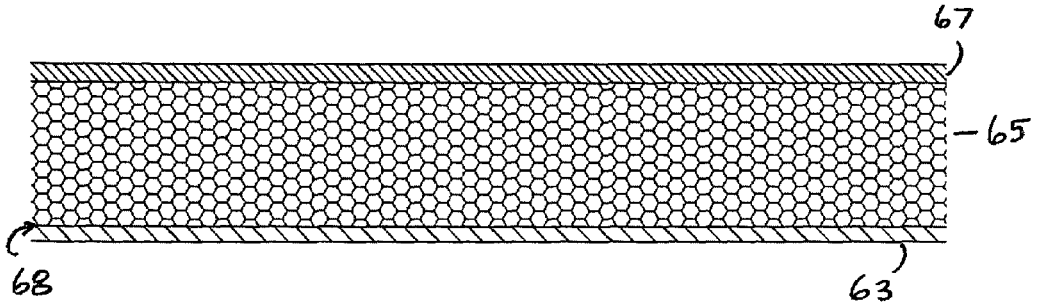
FIG. 12 is a detail drawing showing how the padded substrate layers of the embodiment in FIG. 9 can be adhered or bonded together without the use of mechanical fasteners.

In the preferred version of this embodiment, there are no mechanical fasteners required, as shown in FIG. 12, insofar as the heat welding 68 is designed to bond the foam material 65 directly to the stainless steel mesh 63, and the open cell nature of the foam material 65 will allow most of the water that leaks through the membrane 67 to pass through underneath the foam 65 and through the stainless steel mesh 63, so no openings for the water to pass through is required. In this respect, the foam is preferably heat welded to the stainless steel mesh so that water can easily pass through the foam through the stainless steel mesh; when glue is used, there is a possibility that the water in the open cell foam will not pass through the glue barrier.

Figure 10:
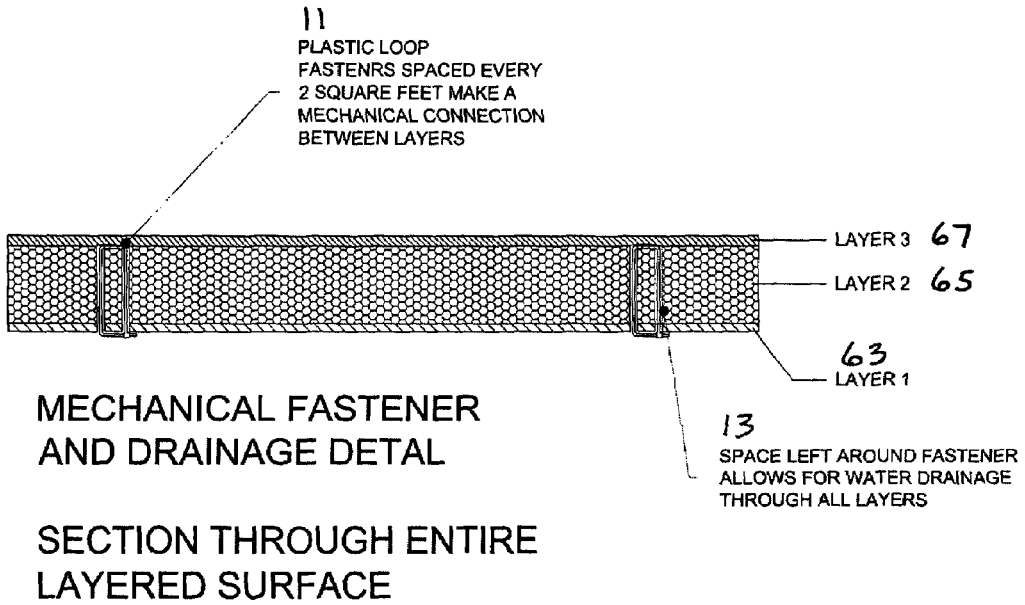
FIG. 10 is a detail drawing showing how the mechanical fasteners are extended through the padded substrate layers of FIG. 9, except the outer membrane, and used to secure the ride surface to the supporting structure underneath.

Alternatively, as with the previous embodiments, a number of mechanical fasteners 11 intermittently spaced apart can also be used to lock the layers together, as shown in FIGS. 9 and 10. Again, the mechanical fasteners 11 preferably comprise plastic loop ties or other connectors which are extended through holes 13 in the layers to mechanically bond the layers together. The fasteners 11 are preferably extended through holes 13 that extend through the foam material 65, and then connected to the supporting structure underneath. Preferably, the holes 13 and fasteners 11 are not extended through the top waterproof membrane, to prevent additional leakage. The holes 13 are adapted so that water that drains through the foam material 65 will more easily pass through the foam layer (through the holes) and out through the bottom of the padded substrate, rather than being trapped therein.

Above the foam layer 65 is preferably provided a layer of waterproof membrane material 67 (layer 3 shown in FIG. 9) which is adapted to provide a water impervious layer on top of the water ride surface. Again, a vinyl fabric material, such as Precontrait series 8000, is a suitable material for this application. The waterproof membrane 67 can be any similar material that will provide the waterproof characteristics for the ride surface. The waterproof membrane 67 preferably is strong and durable to withstand repeated use by participants on the ride surface, and has enough flexibility so that it will not alter the performance characteristics of the foam underneath. Again, how thick the waterproof material 67 should be is dependent on the performance characteristics that are desired to be achieved, as discussed above.

Because the waterproof material 67 typically comes in strips, the material is preferably rolled out and formed over the foam material 65, and can be adhered onto the foam material using a layer of adhesive, such as HH-66 vinyl cement or other similar adhesive. The vinyl cement can be smoothed onto and applied to the foam material 65 and/or waterproof material 67, for proper adhesion. Again, the waterproof strips are preferably glued or otherwise adhered together, such as by being fused, along their seams, to form a contiguous water impervious layer 67 on top of the ride surface.

Figure 8:
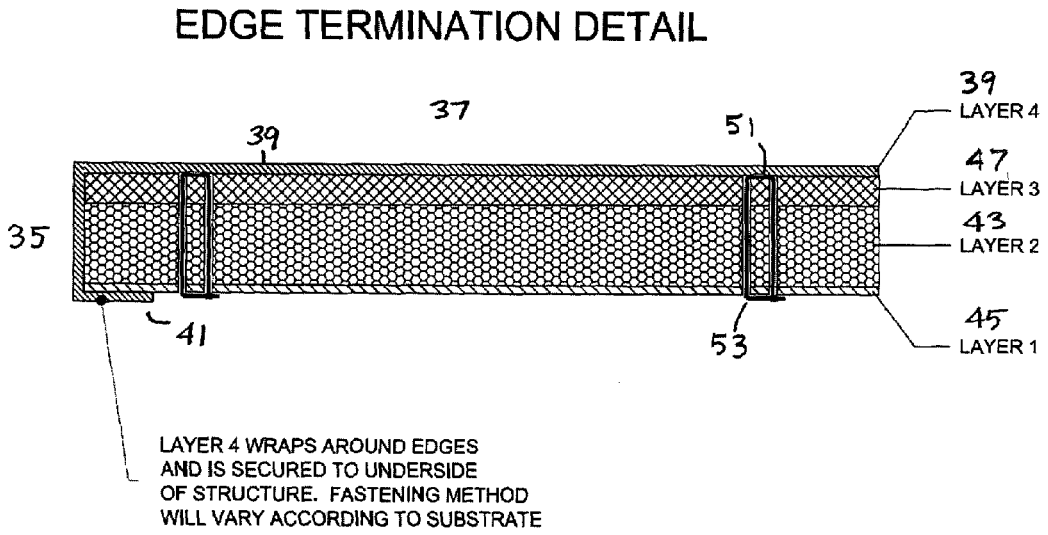
FIG. 8 shows a detail drawing showing how the waterproof membrane is wrapped around the outer edge of the ride surface.

In any embodiment, along the edges 35 of the ride surface 37, as shown in FIG. 8, the waterproof layer 39 is preferably wrapped around the padded substrate and secured to the underside 41 thereof. Preferably, the underside of waterproof layer 39 is glued using HH-66 or other adhesive to the substrate, along the edges 35 and underside 41. The section of layer 39 that wraps underneath and is attached to underside 41 can be positioned under the supporting structure 45, as shown in FIG. 8; this can be true whether the supporting structure 45 is the stainless steel mesh/sub frame 5, 3, 63, 61 (shown in FIGS. 1 and 9), the concrete structure 25 (shown in FIG. 5), or the molded fiberglass structure 17 (shown in FIG. 4), or other structure. It can also be affixed with glue or otherwise adhered to the underside of padded substrate between foam layer 43 and supporting structure 45 (not shown).

In any case, any water that is drained through the permeable layer 47 and/or foam layer 45 is allowed to travel through that layer and down through the openings 53 that have been created to allow the mechanical fasteners 51 to connect the layers together. This way, water being drained from permeable layer 47 and/or foam layer 45 can be drained from the padded substrate through the openings 53, wherein a sufficient number of fasteners 51 and openings 53 are preferably provided so that adequate drainage is possible. This is particularly advantageous when the supporting structure 45 is the stainless steel mesh, which allows water to pass through and into a reservoir underneath. A predetermined number of openings 53 are preferably provided along the lowest edge of the ride surface, to enable water to be adequately drained along the bottom edge of the water ride, to prevent build up of water along the bottom.

When the supporting structure is a fiberglass sub structure, there are preferably holes drilled or otherwise formed into the fiberglass sub structure immediately below each of the fasteners 51 and/or openings 53, so that water passing through the openings 53 can be drained out underneath. A channel system and/or reservoir is preferably provided underneath the fiberglass sub structure capable of draining the water out, and/or re-circulating the water back onto the water ride.

When the supporting structure is a concrete sub structure, there are preferably holes drilled or otherwise formed in the concrete substrate immediately below each of the fasteners 51 and/or openings 53, so that water passing through the openings 53 can be drained out underneath. A channel system and/or reservoir may be used to allow the water to be drained from beneath the concrete substrate.

The improvements discussed herein can be applied to any water ride surface, including wave pools, and other water theme park rides. They can also be applied in connection with any application where there is a need for a substrate, which must be made waterproof on the exterior thereof by the application of a waterproof membrane, and where there is a chance that the membrane would eventually leak.

What is claimed is:

1. A water ride surface, comprising:

a first layer comprising a support member or frame for providing support for the ride surface;

a second layer comprising a foam material;

a third layer comprising a mesh or permeable material which allows water to drain through it;

a fourth layer comprising a waterproof membrane or material; and wherein said second layer is positioned over said first layer, said third layer is positioned over said second layer, and said fourth layer is positioned over said third layer, and wherein said second and third layers are connected to said support member or frame using a plurality of mechanical fasteners extending through a plurality of openings in said second and third layers.

2. The water ride surface of claim 1, wherein said support member or frame is constructed using a steel sub frame, molded fiberglass, and/or concrete.

3. The water ride surface of claim 2, wherein said second layer comprises a closed cell urethane foam material adhered to or otherwise affixed to said support member or frame.

4. The water ride surface of claim 3, wherein said third layer comprises a permeable vinyl mesh material adhered to or otherwise affixed to said second layer.

5. The water ride surface of claim 4, wherein said fourth layer comprises a polyester reinforced vinyl material adhered to or otherwise affixed to said third layer.

6. The water ride surface of claim 3, wherein said second layer has on top thereof a layer of waterproof material sprayed on or otherwise affixed to said second layer.

7. The water ride surface of claim 1, wherein a fifth layer is provided between said support member or frame and said second layer, and wherein said fifth layer comprises a mesh or permeable material which allows water to drain through it.

8. The water ride surface of claim 7, wherein said fifth layer comprises a stainless steel mesh positioned over and onto said support member or frame, wherein said stainless steel mesh is welded or otherwise affixed to said support member or frame.

9. The water ride surface of claim 1, wherein:

a) said support member or frame is constructed using a steel sub frame, molded fiberglass, and/or concrete;

b) said second layer comprises a relatively thick closed cell foam material;

c) said third layer comprises a permeable vinyl mesh material; and/or d) said fourth layer comprises a polyester reinforced vinyl material.

10. The water ride surface of claim 1, wherein water in said third layer is allowed to drain out through said openings in said second and third layers, and wherein additional openings underneath said openings are provided on said support member or frame, to allow said water in said third layer to be drained out underneath the ride surface.

11. A water ride surface, comprising:

a support member or frame for providing support for the ride surface;

a first layer comprising a mesh or porous material which allows water to drain through it;

a second layer comprising a compressible and forgiving material such as foam;

a third layer comprising a mesh or permeable material which allows water to drain through it;

a fourth layer comprising a waterproof membrane or material; and wherein said first layer is positioned over said support member or frame, said second layer is positioned over said first layer, said third layer is positioned over said second layer, and said fourth layer is positioned over said third layer, and wherein said second and third layers are connected to said support member or frame and/or said first layer using a plurality of mechanical fasteners extending through a plurality of openings in said second and third layers.

12. The water ride surface of claim 11, wherein said ride surface comprises at least one of the following:

a) said support member or frame is constructed using a steel sub frame, molded fiberglass, and/or concrete;

b) said first layer comprises a stainless steel mesh positioned over said support member or frame, wherein said stainless steel mesh is welded to or otherwise affixed to said support member or frame;

c) said second layer comprises a relatively thick closed cell foam material adhered to or otherwise affixed to said first layer;

d) said third layer comprises a permeable vinyl mesh material adhered to or otherwise affixed to said second layer; and e) said fourth layer comprises a polyester reinforced vinyl material adhered to or otherwise affixed to said third layer.

13. The water ride surface of claim 11, wherein said second layer has on top thereof a layer of waterproof material sprayed on or otherwise affixed to said second layer.

14. The water ride surface of claim 11, wherein water in said third layer is allowed to drain out through said openings in said second and third layers, and allow said water in said third layer to be drained out underneath the ride surface.

15. A layered padded surface, comprising:

a support member or frame for providing support for the surface;

a first layer comprising a foam material;

a second layer comprising a mesh or permeable material which allows water to drain through it;

a third layer comprising a waterproof membrane or material; and wherein said first layer is positioned over said support member or frame, said second layer is positioned over said first layer, and said third layer is positioned over said second layer, and wherein said first and second layers are connected to said support member or frame using a plurality of mechanical fasteners extending through a plurality of openings in said first and second layers.

16. The padded surface of claim 15, wherein a fourth layer is provided between said support member or frame and said first layer, and wherein said fourth layer comprises a mesh or porous material which allows water to drain through it, wherein said fourth layer comprises a stainless steel mesh positioned over said support member or frame, wherein said stainless steel mesh is welded to or otherwise affixed to said support member or frame.

17. The padded surface of claim 15, wherein said padded surface comprises at least one of the following:

a) said support member or frame constructed of a steel sub frame, molded fiberglass, and/or concrete;

b) said first layer comprises a relatively thick closed cell urethane foam material adhered to or otherwise affixed to said support member or frame;

c) said second layer comprises a permeable vinyl mesh material adhered to or otherwise affixed to said first layer; and d) said third layer comprises a polyester reinforced vinyl material adhered to or otherwise affixed to said second layer.

18. The padded surface of claim 15, wherein said first layer has on top thereof a layer of waterproof material sprayed on or otherwise affixed to said first layer.

19. The padded surface of claim 15, wherein water in said second layer is allowed to drain out through said openings in said first and second layers, and wherein additional openings underneath said openings are provided on said support member or frame, to allow said water in said second layer to be drained out underneath the ride surface.

20. A layered padded surface, comprising:

a support member or frame for providing support for the surface;

a first layer comprising an open cell foam material;

a second layer comprising a waterproof membrane or material; and wherein said second layer is positioned over said first layer, and said first layer is positioned over said support member or frame, and wherein a stainless steel mesh or other porous material which allows water to drain through it is extended above said support member or frame, and said first layer is attached to said stainless steel mesh or other porous material, and wherein said first layer is connected to said stainless steel mesh or porous material and/or support member or frame using a plurality of mechanical fasteners extending through a plurality of openings in said first layer.

21. The surface of claim 20, wherein:

a) said support member or frame is constructed using a steel sub frame, molded fiberglass, and/or concrete;

b) said first layer comprises a relatively thick open cell urethane foam material; and/or c) said second layer comprises a polyester reinforced vinyl material.

22. The surface of claim 20, wherein said first layer is physically connected to said stainless steel mesh or porous material and/or support member or frame using heat weld or adhesive.

* * * * *